US008061134B2

(12) United States Patent
Hasko et al.

(10) Patent No.: US 8,061,134 B2
(45) Date of Patent: Nov. 22, 2011

(54) ANNULAR BURNER ASSEMBLY

(75) Inventors: Stephen Michael Hasko, Huntingdon (GB); David Anthony Clark, Huntingdon (GB); Trevor James Appleton, Cambridge (GB); Heather Allderidge, Derby (GB)

(73) Assignee: Microgen Engine Corporation Holding B.V., Ulft (NL)

( * ) Notice: Subject to any disclaimer, the term of this patent is extended or adjusted under 35 U.S.C. 154(b) by 312 days.

(21) Appl. No.: 12/084,501

(22) PCT Filed: Oct. 27, 2006

(86) PCT No.: PCT/GB2006/004039

§ 371 (c)(1), (2), (4) Date: Mar. 20, 2009

(87) PCT Pub. No.: WO2007/051998

PCT Pub. Date: May 10, 2007

(65) Prior Publication Data

US 2009/0211243 A1 Aug. 27, 2009

(30) Foreign Application Priority Data

Nov. 1, 2005 (GB) ..... 0522309.4

(51) Int. Cl.
*F01B 29/10* (2006.01)

(52) U.S. Cl. ..... 60/521; 60/522; 60/524

(58) Field of Classification Search ..... 60/517–526
See application file for complete search history.

(56) References Cited

U.S. PATENT DOCUMENTS

| | | | | |
|---|---|---|---|---|
| 5,749,720 | A | 5/1998 | Fukuda et al. | 431/285 |
| 6,161,381 | A * | 12/2000 | Lohrmann | 60/523 |
| 6,543,215 | B2 * | 4/2003 | Langenfeld et al. | 60/39.6 |

FOREIGN PATENT DOCUMENTS

| | | |
|---|---|---|
| DE | 102 05 400 | 8/2003 |
| JP | 60 122256 | 6/1985 |
| WO | WO 00/39504 | 7/2000 |
| WO | WO 2004/065778 | 8/2004 |
| WO | WO 2005/054654 | 6/2005 |

OTHER PUBLICATIONS

International Search Report and Written Opinion for Application No. PCT/GB2006/004039 filed Oct. 27, 2006.

* cited by examiner

*Primary Examiner* — Hoang Nguyen
(74) *Attorney, Agent, or Firm* — Ballard Spahr LLP

(57) ABSTRACT

An annular burner assembly having an annular burner mesh. An annular gas/air supply duct supplies a combustible gas/air mixture to the burner mesh in a substantially axial direction. A flow modifier is provided in the vicinity of the burner and has a plurality of fins each extending in a substantially radial plane to define a plurality of passages arranged circumferentially around the supply duct to substantially laminarise the gas/air mixture. The fins provide a thermal link from the burner to a location radially away from the burner. The burner assembly is particularly suited to a Stirling engine.

13 Claims, 2 Drawing Sheets

ANNULAR BURNER ASSEMBLY

CROSS-REFERENCE TO RELATED APPLICATIONS

The present application is a National Phase Application of International Application No. PCT/GB2006/004039, filed Oct. 27, 2006, which claims priority to Great Britain Patent Application No. 0522309.4, filed Nov. 1, 2005, which applications are incorporated herein fully by this reference.

The present invention relates to an annular burner assembly.

Such a burner assembly is employed, for example, in a Stirling engine in which the burner is arranged to surround the head of a Stirling engine.

The burner is supplied with a gas/air mixture which is ignited at a burner mesh. The gas is typically natural gas, biogas or some other methane rich fuel. The flow of the mixture of gas/air which is supplied is turbulent in nature which will impair its flow to the burner mesh. Also, the burner mesh must be maintained at a temperature at which the material of which it is constructed does not degrade (typically at around 1050° C.). In addition, by keeping the burner cool, emissions can be minimised, particularly those of oxides of nitrogen.

According to a first aspect of the present invention there is provided an annular burner assembly centred on a main axis, the assembly comprising an annular burner mesh, an annular gas/air supply duct to supply a combustible gas/air mixture to the burner mesh in a substantially axial direction, and a flow modifier in the vicinity of the burner and having a plurality of fins each extending in a substantially radial plane to define a plurality of axially extending passages arranged circumferentially around the supply duct to substantially laminarise the gas/air mixture, the fins providing a thermal link from the burner to a location radially away from the burner.

By providing a flow modifier in the vicinity of the burner, the flow to the burner is substantially laminarised. Also, the fins provide a thermal link from a position adjacent to the burner mesh to a location radially away from the burner thereby promoting the flow of heat away from the surface of the burner helping to maintain the burner at an acceptable temperature.

The flow modifier may either be positioned in substantially the same radial plane as the burner mesh. Alternatively, it may be positioned immediately upstream of the burner mesh. Alternatively, the flow modifier may be arranged in an intermediate position which is partly in the same radial plane as the burner mesh and partly upstream of the burner mesh.

The flow modifier may be formed as an outer ring to which the fins are fixed in order to provide the plurality of passages. However, preferably, the flow modifier is formed of a single corrugated member. This greatly simplifies the structure of the distribution ring.

If the distribution ring is axially offset from the burner, then the exact configuration of the corrugations is relatively unimportant as the gas/air mixture can pass either side of the corrugated member. However, when the flow modifier is positioned in substantially the same radial plane as the flow burner mesh, the space on the radially outwardly facing side of the corrugated member is dead space as the gas/air in this space cannot directly reach the burner mesh. Therefore, preferably, the corrugations are arranged such that the space between adjacent corrugations on the radially outwardly facing side of the corrugated member is minimised. Ideally, this space is eliminated. With such a configuration, the corrugated member will generally resemble an annular member with radially inwardly extending fins as mentioned above.

Preferably, a perforate flow distribution ring is provided at the radially innermost edge of the plurality of passages and in close proximity to the radially outer surface of the burner mesh. This further ensures the even distribution of the gas/air mix to the burner mesh.

Examples of burner assemblies in accordance with the present invention will now be described with reference to the accompanying drawings, in which.

Figure 1A:
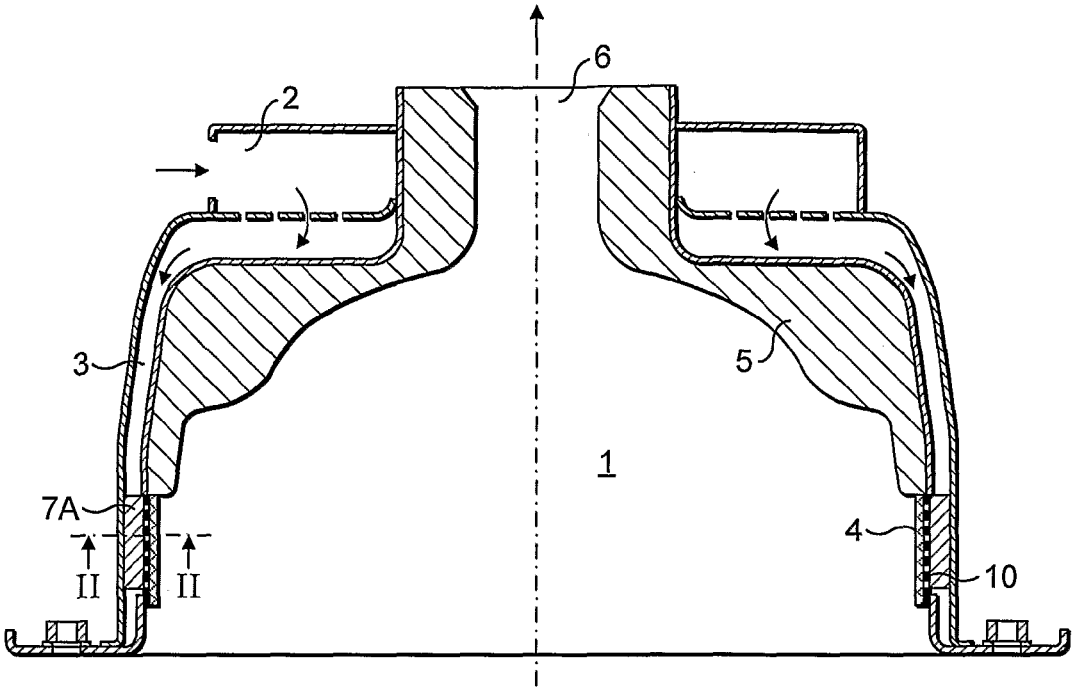
FIG. 1A is a cross-section of a first example of burner assembly suitable for use with a Stirling engine.
Figure 1B:
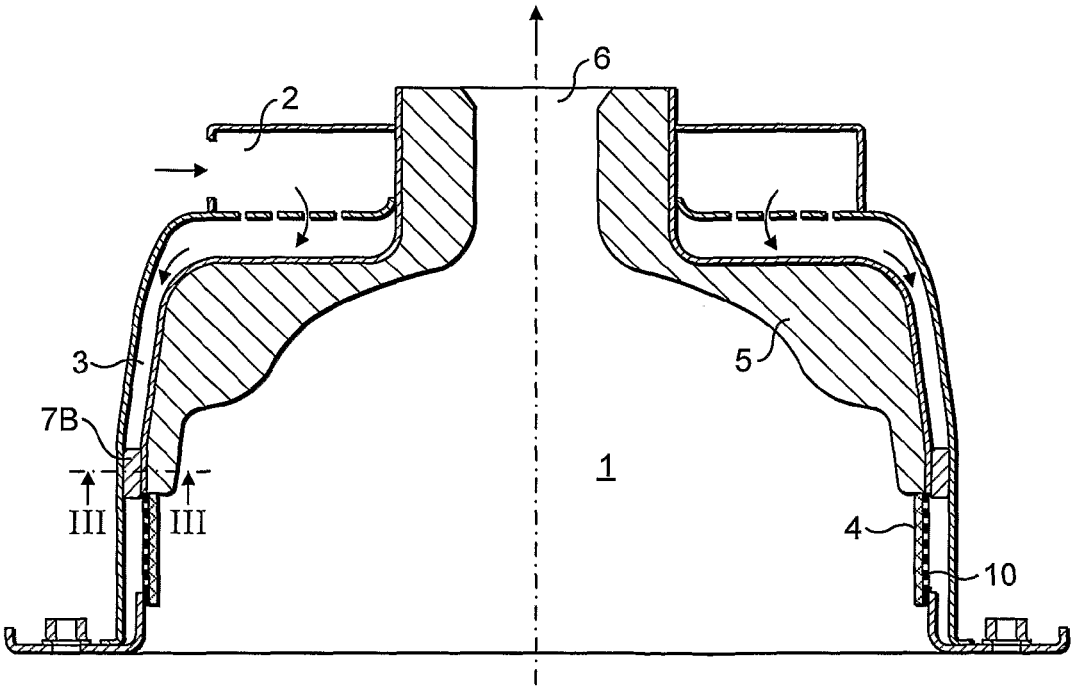
FIG. 1B is a similar view of a second example of a burner assembly.

FIGS. 1A and 1B show similar burner assemblies suitable for supply of heat to the head of a Stirling engine. The assembly comprises a main central cavity 1 in which the Stirling engine is positioned, in use, as shown, for example, in WO03/052328. However, the burner could also be an outwardly firing burner as is known in the art. The assembly is set up as a recuperator, such that exhaust gas from the Stirling engine burner is used to pre-heat the incoming gas/air mixture. The gas/air mixture enters along supply duct 2 and then flows along an annular inlet duct 3 to be ignited at burner mesh 4. The exhaust gas from the Stirling engine burner flows along the inner surface of insulated recuperator body 5 and out through exhaust gas port 6, as it does so giving up its heat to the gas/air entering along ducts 2 and 3.

In order to laminarise the generally turbulent flow in the annular duct 3, a flow modifier is provided. This may either be in the same radial plane as the burner mesh 4 as depicted at 7A in FIG. 1A, or may be axially spaced from the burner mesh 4 as depicted as 7B in FIG. 1B.

The configuration of the flow modifiers is described in more detail with reference to FIGS. 2 to 4.

Figure 2:
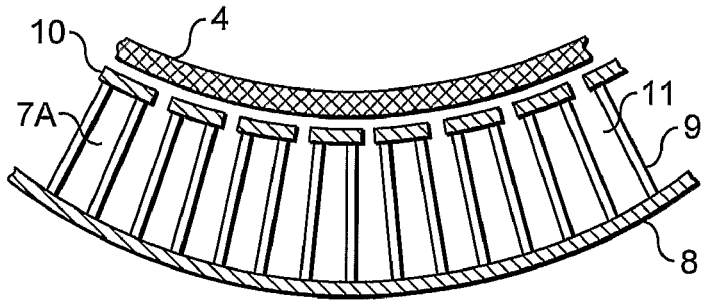
FIG. 2 shows a segment of the burner assembly taken along line II/II in FIG. 1A showing a first flow modifier.

FIG. 2 shows the first flow modifier 7A. The flow modifier comprises an outer wall 8 which may either be the outer wall of the annular duct 3 or may be a separate member. A plurality of fins 9 extend radially inwardly from the wall 8. A perforate metal strip 10 provides a distribution ring at the radially innermost edge of the flow modifier and is adjacent to the radially outermost face of the burner mesh 4. The fins 9 could be mounted individually in place, or may each be attached to a common component which is then mounted in place in a single step.

In use, the heated gas/air mixture flows axially along passages 11 between fins 9 and out through distribution ring 10 to the burner mesh 4. The fins 9 serve a dual function of laminarising the flow immediately upstream of the burner, and also serving to convey heat from the burner mesh radially outwardly towards the outer wall of the inlet duct 3.

Figure 3:
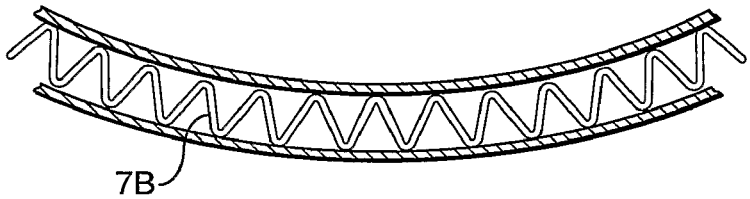
FIG. 3 shows a similar segment of the flow modifier only taken along line III/III in FIG. 1B showing a second flow modifier.

FIG. 3 shows the second flow modifier 7B. This is simply a corrugated strip having an annular configuration which extends around the annular duct 3 axially upstream of the burner 4. Each part of the corrugation extends in a substantially radial plane, in the sense that, although not in a truly radial plane, the fins extend in a direction which is predominantly radial. The construction of this ring is simpler than the ring 7A. Also, in view of its proximity to the burner mesh 4, the distribution strip will still serve to provide a thermal path to the outer wall of the inlet duct 3 and incoming gas/air mixture. However, this effect will be less pronounced than the effect achieved by the flow modifier 7A.

Figure 4:
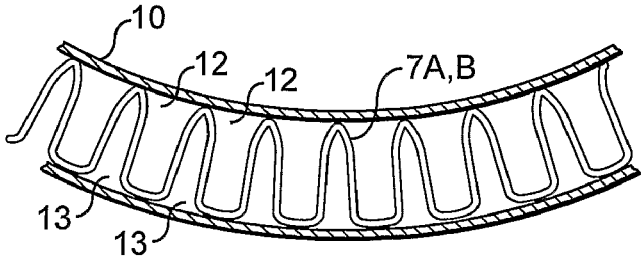
FIG. 4 shows an alternative flow modifier which could be used in place of either of the flow modifiers of FIGS. 2 and 3.

FIG. 4 shows a flow modifier which may be used as an alternative to either of the previous modifiers. This ring may therefore either be positioned in the same radial plane as the burner mesh 4 as shown as 7A in FIG. 1A, or may be positioned in the axially offset position of 7B in FIG. 1B.

In common with FIG. 3, the flow modifier of FIG. 4 is formed from a single corrugated strip. However, the corrugations are arranged such that pockets 12 on the radially inwardly facing side are significantly larger than pockets 13 formed on the radially outwardly facing side. In the limiting case, the pockets 12 can be enlarged to the extent that the adjacent faces of the corrugation touch one another thereby substantially eliminating pockets 13. Such an arrangement can therefore be used immediately behind the burner mesh in contact with the distribution ring 10 as the dead space outside the ring is reduced or eliminated. The ring also retains the advantage of simplicity of construction of FIG. 3, such that it is also applicable in the position of ring 7B.

The invention claimed is:

1. An annular burner assembly centred on a main axis, the assembly comprising an annular burner mesh, an annular gas/air supply duct to supply a combustible gas/air mixture to the burner mesh in a substantially axial direction, and a flow modifier in the vicinity of the burner and having a plurality of fins each extending in a substantially radial plane to define a plurality of passages arranged circumferentially around the supply duct to substantially laminarise the gas/air mixture, the fins providing a thermal link from the burner to a location radially away from the burner.

2. An assembly according to claim 1, wherein the flow modifier is positioned in substantially the same radial plane as the burner mesh.

3. An assembly according to claim 1, wherein the flow modifier is positioned immediately upstream of the burner mesh.

4. An assembly according to claim 1, wherein the flow modifier is formed of a single corrugated member.

5. An assembly according to claim 4, wherein the corrugations are arranged such that the space between adjacent corrugations on the radially outwardly facing side of the corrugated member is minimised.

6. An assembly according to claim 4, wherein the corrugations are arranged such that the space between adjacent corrugations on the radially outwardly facing side of the corrugated member is eliminated.

7. An assembly according to claim 1, wherein a perforate flow distribution ring is provided at the radially innermost edge of the plurality of passages and in close proximity to the radially outer surface of the burner mesh.

8. A Stirling engine assembly comprising a Stirling engine and a burner according to claim 1 surrounding the engine.

9. An assembly according to claim 2, wherein the flow modifier is formed of a single corrugated member.

10. An assembly according to claim 3, wherein the flow modifier is formed of a single corrugated member.

11. An assembly according to claim 2, wherein a perforate flow distribution ring is provided at the radially innermost edge of the plurality of passages and in close proximity to the radially outer surface of the burner mesh.

12. An assembly according to claim 3, wherein a perforate flow distribution ring is provided at the radially innermost edge of the plurality of passages and in close proximity to the radially outer surface of the burner mesh.

13. An assembly according to claim 4, wherein a perforate flow distribution ring is provided at the radially innermost edge of the plurality of passages and in close proximity to the radially outer surface of the burner mesh.

* * * * *